US007686594B2

(12) United States Patent
Iversen et al.

(10) Patent No.: US 7,686,594 B2
(45) Date of Patent: Mar. 30, 2010

(54) REFRIGERANT COMPRESSOR ARRANGEMENT

(75) Inventors: Frank Holm Iversen, Padborg (DK); Marten Nommensen, Flensburg (DE); Heinz Otto Lassen, Flensburg (DE); Christian Petersen, Hattstedt (DE)

(73) Assignee: Danfoss Compressors GmbH, Flensburg (DE)

( * ) Notice: Subject to any disclaimer, the term of this patent is extended or adjusted under 35 U.S.C. 154(b) by 663 days.

(21) Appl. No.: 11/010,843

(22) Filed: Dec. 13, 2004

(65) Prior Publication Data

US 2005/0135955 A1 Jun. 23, 2005

(30) Foreign Application Priority Data

Dec. 18, 2003 (DE) ..... 103 59 562

(51) Int. Cl.
*F04B 39/00* (2006.01)
*F04B 53/00* (2006.01)

(52) U.S. Cl. ..... 417/312; 417/902

(58) Field of Classification Search ..... 417/312, 417/902; 215/47, 48, 49

See application file for complete search history.

(56) References Cited

U.S. PATENT DOCUMENTS

| | | | | |
|---|---|---|---|---|
| 4,969,804 | A | 11/1990 | Gannaway | 417/360 |
| 5,222,885 | A * | 6/1993 | Cooksey | 418/96 |
| 5,261,800 | A * | 11/1993 | Sakae | 418/63 |
| 5,803,717 | A * | 9/1998 | Iversen et al. | 417/312 |
| 6,138,849 | A * | 10/2000 | Roemer et al. | 215/48 |
| 6,312,233 | B1 * | 11/2001 | Ahn et al. | 417/312 |

FOREIGN PATENT DOCUMENTS

DE 4411191 C2 10/1995

* cited by examiner

*Primary Examiner*—Devon C Kramer
*Assistant Examiner*—Peter J Bertheaud
(74) *Attorney, Agent, or Firm*—McCormick, Paulding & Huber LLP

(57) ABSTRACT

The invention concerns a refrigerant compressor arrangement with a compressor having a suction inlet, a casing, in which the compressor is located, a suction socket, which is in communication with the casing, a suction opening in the casing, which is connected with the suction socket, and a telescopic pipe, which is located between the suction inlet and the suction opening in the casing. It is endeavored to manufacture a refrigerant compressor arrangement in a cost-effective manner. For this purpose, the suction opening is surrounded by a drawing through in the casing wall, whose inner wall forms a sliding surface for the telescopic pipe.

20 Claims, 1 Drawing Sheet

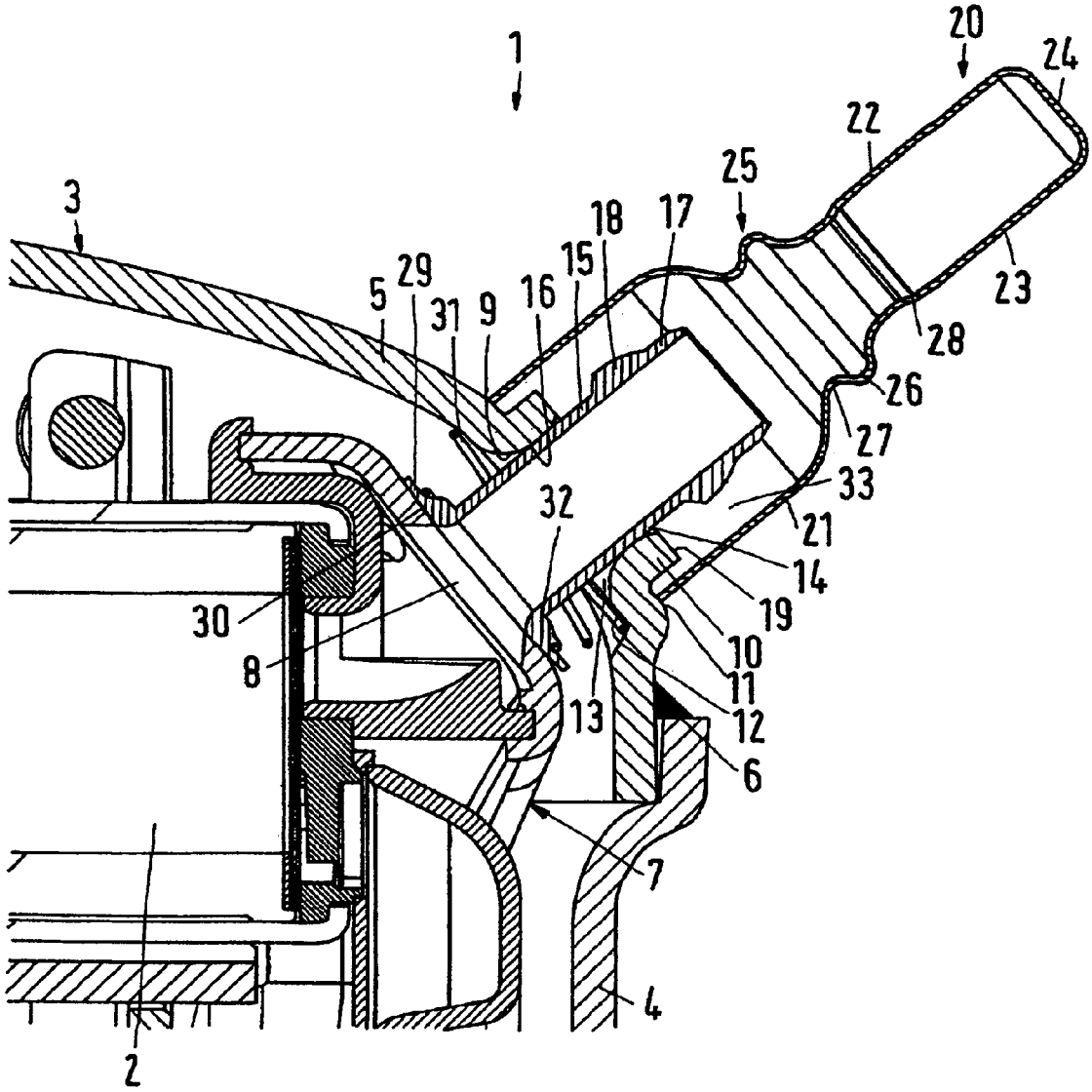
1
20
24
22
25
3
18
17
29
15
5
31
9
16
23
28
26
27
33
32
21
14
19
30
10
8
11
13
12
6
7
4
2

REFRIGERANT COMPRESSOR ARRANGEMENT

CROSS-REFERENCE TO RELATED APPLICATIONS

This application is entitled to the benefit of and incorporates by reference essential subject matter disclosed in German Patent Application No. 103 59 562.7 filed on Dec. 18, 2003.

FIELD OF THE INVENTION

The invention concerns a refrigerant compressor arrangement with a compressor having a suction inlet, a casing, in which the compressor is located, a suction socket, which is connected with the casing, a suction opening in the casing, which is in communication with the suction socket, and a telescopic pipe, which is located between the suction inlet and the suction opening in the casing.

BACKGROUND OF THE INVENTION

Such a refrigerant compressor arrangement is known from DE 44 11 191 C2. The telescopic pipe permits the compressor to move in relation to the casing. Such a movement possibility is required in that the compressor is flexibly supported in the casing. The flexible support is provided to prevent a transfer of noises from the compressor to the casing. In the known case, the suction socket is flush-mounted with the outside of the casing. Thus, the telescopic pipe not only projects through the suction opening in the casing, but also projects into the suction socket. Accordingly, the inside of the suction socket has to be worked to prevent the telescopic pipe from getting stuck here during a retraction movement. In an improved embodiment, it has therefore been suggested to locate a pipe holder between the telescopic pipe and the suction socket, in which the telescopic pipe should slide.

U.S. Pat. No. 4,969,804 shows a further refrigerant compressor arrangement, with a pipe element located inside a casing, the inner end of said pipe element being displaceable in the axial direction into an opening of the compressor block. The outer end of the pipe element is guided in a suction socket, which is fixed on the casing.

SUMMARY OF THE INVENTION

The invention is based on the task of providing a cost effective refrigerant compressor arrangement.

The invention solves this problem in that the suction opening is surrounded by a drawing through in the casing wall, whose inner wall forms a sliding surface for the telescopic pipe.

With this embodiment, the manufacturing of the refrigerant compressor arrangement is simplified. A drawing through merely has to be made in the casing wall, that is, during or after the manufacturing of the suction opening, a part of the casing wall surrounding the suction opening must be reshaped practically at right angles, so that a cylinder-like extension of the casing is formed. During the reshaping, this extension can already be made so smooth on its inside that it forms a sliding surface for the telescopic pipe. Thus, neither a working of the inside of the suction socket, nor a pipe holder for holding the telescopic pipe are required. With the reshaping of the casing in the area of the suction opening, all elements required for the function are provided.

It is preferred that the telescopic pipe projects through the drawing through and has a protrusion arrangement on a section projecting from the drawing through, said protrusion arrangement forming, together with the outer frontside of the drawing through, a movement limitation device. The protrusion arrangement can, for example, be formed by one or more protrusions on the outside of the telescopic pipe, which are distributed in the circumferential direction. During mounting, the telescopic pipe is pushed into the drawing through, that is, the suction opening surrounded by the drawing through, from the inside of the casing. The telescopic pipe is so flexible that the protrusions can be pushed through the drawing through. Without a pressure from the outside, however, the diameter of the telescopic pipe will not be reduced so much that the protrusions can pass through the drawing through again.

Preferably, the suction opening has an increasing diameter at both ends of the drawing through. The diameter increase can be made in a rounded manner. However, it can also be purely conical. This diameter increase, together with a small play of the telescopic pipe in relation to the inside of the drawing through, enables a tilting movement of the telescopic pipe in relation to the casing. This gives a small leakage between the telescopic pipe and the casing. However, this can be tolerated and is therefore accepted.

Preferably, the drawing through is directed outwards from the casing. In this case, it does not disturb the inside of the casing, that is, the casing can be made as small as possible.

Preferably, the suction socket surrounds the drawing through with a fixing section. Thus, the fixing section and the telescopic pipe are decoupled from each other.

It is also advantageous that the fixing section surrounds the drawing through with a distance to all sides. A connection between the suction socket and the casing can then be realised by means of thermal connecting methods, for example, resistance or friction welding, without risking that thermal tensions in the area of the drawing through will have a negative influence on the movability of the telescopic pipe in the drawing through. It is even possible to weld the suction socket on after mounting the telescopic pipe, without risking that the telescopic pipe is damaged by the heat influence.

It is also advantageous when an annular chamber is formed between the suction socket and the section of the telescopic pipe projecting from the drawing through. In this annular chamber a share of the oil from the refrigerant circuit circulating with the gaseous refrigerant can gather and dam up. It then flows through the gap mentioned above between the telescopic pipe and the inside of the drawing through back into the inside of the casing. At the same time, the annular chamber serves as a collecting space for any loose dirt particles carried along by the gas flow, to prevent such particles from reaching the compressor.

Preferably, the suction opening is surrounded by a plane surface. This surface is then located on the opposite side of the drawing through, that is, when the drawing through is directed outwards, on the inside of the casing. This surface can then preferably be used as counter flange for a pressure spring, which presses the telescopic pipe against the suction inlet of the compressor. A plane surface makes it easier to align the spring.

It is also advantageous when the drawing through is surrounded by a plane surface. This plane surface can then be used for mounting purposes, for example, for the mounting of the suction socket.

Preferably, the suction socket is supported on the plane surface. The suction socket can then have a frontside, which lies in a plane, on which the centre axis of the suction socket is arranged to be perpendicular. This simplifies the manufacturing.

Preferably, at the end facing away from the casing, the suction socket has a cylinder section, which is closed on the face side, the cylinder section having a predetermined break point. The cylinder section has a smaller diameter than the fixing section. By means of the suction socket, it is thus possible in a simple manner to adapt the refrigerant compressor arrangement to different pipe diameters of a refrigeration system, merely by replacing the suction socket. Thus, a large number of refrigeration systems can be supplied with one single type of compressors. The fact that the cylinder section is closed, means that after mounting the refrigerant compressing arrangement is closed towards the environment, at least in the area of the suction section of the compressor. Therefore, the compression arrangement can be produced to stock, without requiring that soon after manufacturing a connection with the piping system of a refrigeration system have to be made. When the connection is to be made, the cylinder section is simply opened at the predetermined break point. Then, the end of the pipe of a refrigeration system can be inserted and connected with the suction socket, for example by soldering or welding. The use of a predetermined break point in this connection is known per se from DE 1 977 834 U1.

Preferably, the fixing section and the cylinder section are connected by means of a corrugated pipe-like section. This corrugated pipe-like section permits a simple adaptation to customer-specific mounting conditions in a refrigeration system. If required, it can be compressed or expanded, or it can bend the cylinder section in relation to the fixing section.

Preferably, in the area of the corrugated pipe-like section, the cylinder section has a diameter reduction. The diameter reduction prevents that a pipe of a refrigeration system, with which the compressing arrangement shall be connected, is displaced too far in the direction of the telescopic pipe. A collision between the telescopic pipe and the pipe of the refrigeration system is thus prevented with a large reliability. The diameter reduction must not necessarily be located directly on the transition to the corrugated pipe-like section. However, a sufficient length should be provided for fixing an end of the pipe of the refrigeration system.

Preferably, the suction socket has a smaller wall thickness than the casing. When the suction pipe only has a small wall thickness, it will be a poor conductor of heat from the hot casing, when it is made of metal. Thus, heat can be kept away from the supplied refrigerant gas. The colder the gas is, which is sucked in, the larger is the efficiency of the compressor.

Preferably, the telescopic pipe has a bearing surface on the compressor, which is, at least in sections, made to be spherical. Also this makes it possible for the compressor to tilt within a small angular range in relation to the telescopic pipe.

It is also advantageous, when the compressor has a supporting surface surrounding the suction inlet, said supporting surface having, at least in sections, a spherical shape. The bearing surface of the telescopic pipe bears on this supporting surface. When one of these surfaces or even both of them are made to be spherical, that is, modelling a part of a ball surface, the corresponding ball having a relatively large diameter, the tilting possibility is further improved, without causing significant sealing problems. Further, in this manner a simpler alignment of the suction inlet and the telescopic pipe in relation to each other is ensured.

Preferably, the suction inlet is formed on a suction muffler located on the compressor, the outer wall of said suction muffler being made of a plastic material. Making the outer wall of the suction muffler of a plastic material involves several advantages. Firstly, a plastic material is usually a good heat isolator, so that a heat transfer to the refrigerant gas located inside the suction muffler can be prevented in a simple manner. Secondly, a plastic material is easy to shape or to work, so that the supporting surface can be made in accordance with the characteristics described above. Finally, a plastic material usually has good muffling properties.

BRIEF DESCRIPTION OF THE DRAWINGS

In the following, the invention is described on the basis of a preferred embodiment in connection with the drawing, showing:

FIG. 1 is a sectional view of a refrigerant compressor arrangement.

DETAILED DESCRIPTION OF THE PREFERRED EMBODIMENTS

A refrigerant compressor arrangement 1 has a merely schematically shown compressor 2, usually a piston reciprocating in a cylinder, the compressor 2 being flexibly suspended in a hermetically closed casing 3. The casing 3 has a bottom part 4 and a top part 5, which are connected in a gas-tight manner by means of a welding seam 6 or a similar connection.

The compressor 2 has a suction muffler 7, which is made of a plastic material. The suction muffler 7 has an opening, which forms a suction inlet 8 of the compressor 2. During operation, refrigerant gas is sucked into the suction muffler 7 via the suction inlet 8, from where it reaches the inside of the compressor 2 during a suction stroke.

The top part 5 of the casing 3 has a suction opening 9, which is surrounded by a drawing through 10. The drawing through is manufactured during or after the manufacturing of the suction opening 9, in that part of the top part 5 of the casing 3 surrounding the initially smaller suction opening is reshaped towards the outside, so that a practically cylindrically shaped extension occurs, which surrounds the suction opening 9. The drawing through 10 is surrounded by a plane surface 11. A correspondingly plane surface 12 is located on the inside of the casing 3. The surface 12 surrounds the suction opening 9. The plane surfaces 11, 12 can be manufactured simultaneously with the manufacturing of the drawing through 10.

The suction opening 9, which is surrounded by the drawing through 10, has at its inner end a diameter increase 13 and at its outer end a diameter increase 14. A telescopic pipe 15 is led through the drawing through 10 with a small play, an inner wall 16 of the drawing through 10 forming a sliding surface for the telescopic pipe 15. Due to the diameter increases 13, 14, however, the telescopic pipe 15 is not only movable in the direction of its axis, but also has a small tilting movability in relation to the casing 3.

On a section 17, which projects from the drawing through 10, the telescopic pipe 15 has several protrusions 18. During an inwards movement of the telescopic pipe 15, the protrusions 18 will come to rest on a frontside 19 of the drawing through 10. This frontside 19 is made to be plane, and extends practically at right angles to the longitudinal axis of the telescopic pipe 15. Together with the protrusions 18, the frontside 19 forms a movement limitation device. The telescopic pipe is so flexible that, when inserted in the drawing through 10 from the inside, it can be somewhat compressed, so that the protrusions 18 can pass through the drawing through 10. Without a corresponding compression of the telescopic pipe 15 in the radial direction, however, the telescopic pipe 15 can no longer be pushed out of the suction opening.

A suction socket 20 made with relatively thin walls and having a smaller wall thickness than the top part 5 of the casing 3, is made of copper or a copper-plated steel, for example stainless steel. The suction socket 20 has a fixing section 21, whose frontside is supported and fixed on the surface 11 on the outside of the casing 3, for example by resistance welding or friction welding. For this purpose, the surface 11 can be provided with a circumferential, bulge-like protrusion before fixing the suction socket, the diameter of said protrusion corresponding to that of the fixing section 21, the protrusion serving as welding projection. The fixing section 21 surrounds the complete outside of the drawing through 10 at a certain distance. The distance between the fixing section 21 and the drawing through 10 permits the connection of the fixing section 21 and the casing 3 by means of a thermal process, for example welding or soldering, without risking that thermal tensions will act directly upon the drawing through 10.

Further, the suction socket 20 has a cylinder section 22 with a smaller diameter than the fixing section 21. At the cylinder section 22 is provided a predetermined break point 23 in the form of a circumferential groove. Before mounting the compressor arrangement 1 in a refrigeration system, the closed end section 24 of the suction socket 20 is simply broken off, so that an opening occurs for the insertion of a suction pipe of the refrigeration system, which can be welded or soldered onto the cylinder section 22 of the suction socket 20.

With different suction sockets 20, the diameter of the fixing section 21 is the same. However, the diameter of the cylinder section 22 can vary. In this way, it is possible to adapt the refrigerant compressor arrangement 1 to different pipe diameters of different refrigeration systems.

The cylinder section 22 and the fixing section 21 are connected with each other by means of a corrugated pipe-like section 25. The corrugated pipe-like section 25 has at least one wave crest 26 and one trough 27. It permits a simple adaptation to customer-specific mounting conditions in the refrigeration system. At the end next to the corrugated pipe-like section 25, the cylinder section 22 has a diameter reduction 28. This diameter reduction 28 limits the insertion length of an external suction pipe into the suction socket 20.

The thin-walled embodiment of the suction socket 20 firstly causes an increased flexibility of the corrugated pipe-like section 25. Secondly, it also causes poor heat conduction through the suction socket 20. The fact that the section of the suction path, which is next to the casing 3, is formed by the telescopic pipe 15, which is also made of a plastic material, results in a relatively small heating of the suction gas, which is sucked in through the telescopic pipe 15.

At the end next to the suction muffler 7, the telescopic pipe 15 has a circumferential flange 29 with a bearing surface 30. The bearing surface 30 is made to be slightly spherical, which further improves the tilting movability of the telescopic pipe in relation to the suction muffler 7. The flange 29 also serves for supporting a spring 31, which is suspended between the flange 29 and the surface 12 and presses the telescopic pipe 15 into the inside of the casing 3. The spring 31 is made as a conical helical compression spring. When the telescopic pipe 15 is displaced to its outer end position, all windings of the spring 31 bear on the surface 12 in one plane.

The suction muffler 7 has a bearing surface 32 surrounding the suction inlet 8, said bearing surface 32 also being slightly spherical. Also this spherical bearing surface 32 improves the tilting ability of the telescopic pipe 15 in relation to the suction muffler 7.

An annular chamber 33 is formed between the fixing section 21 and the telescopic pipe 15. In this annular chamber a part of the oil, which circulates with the refrigerant gas flow, can gather. The oil dams up in this chamber 33, before it flows back into the inside of the casing 3 through the gap (play) between the telescopic pipe 15 and the drawing through 10. At the same time, the chamber 33 also serves as a collecting space for any loose dirt particles carried along by the gas flow, to prevent such particles from reaching the compressor unit.

The movements inside the casing occurring during operation of the compressor 2 can be adopted by the telescopic device, that is, by the movability of the telescopic pipe 15 in the drawing through 10. In this manner, a substantial sealing of the suction path is ensured at all times. This sealing must not be hermetical. It is to a high extent permissible that small gas amounts from the inside of the casing 3 can get into the inside of the suction socket 20. However, these gas amounts are extremely small. Axial movements of the compressor (in relation to the drawing through 10, are adopted by a displacement of the telescopic pipe 15 in the drawing through 10, the telescopic pipe 15 being guided on the sliding surface of the drawing through 10 formed by the inner wall 16. During a radial movement, the surfaces 30, 32 can, within certain limits, be displaced in relation to each other, without causing an opening of the gas path into the inside of the casing 3. Tilting movements can also be accepted due to the play between the telescopic pipe 15 and the drawing through 10.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A refrigerant compressor arrangement with a compressor comprising: a suction inlet, a casing, in which the compressor is located, a suction socket, which is connected with the casing, a suction opening in the casing, which is in communication with the suction socket, and a telescopic pipe, which is located between the suction inlet and the suction opening in the casing, wherein the suction opening is surrounded by a drawing through formed in the casing wall, and extending outwardly therefrom, whose inner wall surface remains in sliding contact with the telescopic pipe, the surface allowing pivotal movement of the telescopic pipe.

2. The arrangement according to claim 1, wherein the telescopic pipe projects through the drawing through and has a protrusion arrangement on a section projecting from the drawing through, said protrusion arrangement forming, together with the outer frontside of the drawing through, a movement limitation device.

3. The arrangement according to claim 1, wherein the suction opening has an increasing diameter at both ends thereof.

4. The arrangement according to claim 1, wherein the drawing through is directed outwards from the casing.

5. The arrangement according to claim 1, wherein the suction socket surrounds the drawing through with a fixing section.

6. The arrangement according to claim 5, wherein the fixing section surrounds the drawing through with a distance to all sides.

7. The arrangement according to claim 2, wherein an annular chamber is formed between the suction socket and the section of the telescopic pipe projecting from the drawing through.

8. The arrangement according to claim 1, wherein the suction opening is surrounded by a plane surface.

9. The arrangement according to claim 1, wherein the drawing through is surrounded by a plane surface.

10. The arrangement according to claim 9, wherein the suction socket is supported on the plane surface.

11. The arrangement according to claim 5, wherein at the end facing away from the casing, the suction socket has a cylinder section, which includes a closed end section, the cylinder section having a predetermined break point.

12. The arrangement according to claim 11, wherein the fixing section and the cylinder section are connected by means of a corrugated pipe-like section.

13. The arrangement according to claim 12, wherein in the area of the corrugated pipe-like section, the cylinder section has an inner diameter reduction.

14. The arrangement according to claim 1, wherein the suction socket has a smaller wall thickness than the casing.

15. The arrangement according to claim 1, wherein the telescopic pipe has a bearing surface on the compressor, which is, at least in sections, made to be spherical.

16. The arrangement according to claim 1, wherein the compressor has a supporting surface surrounding the suction inlet, said supporting surface having, at least in sections, a spherical shape.

17. The arrangement according to claim 16, wherein the suction inlet is formed on a suction muffler located on the compressor, the outer wall of said suction muffler being made of a plastic material.

18. The refrigerant compressor arrangement according to claim 1, wherein the drawing through is formed integrally with the casing wall.

19. The refrigerant compressor arrangement according to claim 1, wherein the sliding surface of the drawing through allows tilting movement of the telescoping pipe therein.

20. A refrigerant compressor arrangement with a compressor comprising:

a suction inlet;

a casing, in which the compressor is located;

a suction socket, which is connected with the casing;

a suction opening in the casing, which is in communication with the suction socket; and a telescopic pipe, which is located between the suction inlet and the suction opening in the casing;

wherein the suction opening is surrounded by a drawing through formed in the casing wall, and extending outwardly therefrom, whose inner wall surface remains in sliding contact with the telescopic pipe, the surface allowing pivotal movement of the telescopic pipe; and wherein the drawing through is formed such that the suction opening has an increasing diameter at both ends thereof.

* * * * *